US009507300B2

(12) United States Patent
Hayase et al.

(10) Patent No.: US 9,507,300 B2
(45) Date of Patent: Nov. 29, 2016

(54) FIXING DEVICE

(71) Applicant: Konica Minolta, Inc., Chiyoda-ku, Tokyo (JP)

(72) Inventors: Toru Hayase, Toyohashi (JP); Mamoru Fukaya, Nagoya (JP); Naoki Kataoka, Toyokawa (JP); Tsuyoshi Tamaru, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/664,153

(22) Filed: Mar. 20, 2015

(65) Prior Publication Data

US 2015/0268607 A1 Sep. 24, 2015

(30) Foreign Application Priority Data

Mar. 20, 2014 (JP) ..... 2014-057579

(51) Int. Cl.
*G03G 15/20* (2006.01)
*G03G 21/16* (2006.01)

(52) U.S. Cl.
CPC ..... *G03G 15/2053* (2013.01); *G03G 15/2017* (2013.01); *G03G 15/2064* (2013.01); *G03G15/2071* (2013.01); *G03G 21/16* (2013.01); *G03G 2221/1639* (2013.01); *G03G 2221/1675* (2013.01)

(58) Field of Classification Search
CPC ..... G03G 15/20
USPC ..... 399/122
See application file for complete search history.

(56) References Cited

U.S. PATENT DOCUMENTS 5,732,309 A * 3/1998 Okuno ..... G03G 15/2064 399/320
2006/0289417 A1* 12/2006 Kagawa ..... G03G 15/2064 219/216

(Continued)

FOREIGN PATENT DOCUMENTS

JP S59-116774 A 7/1984
JP 05-188805 * 7/1993 ..... G03G 15/20

(Continued)

OTHER PUBLICATIONS

Notification of Reasons for Refusal issued by the Japanese Patent Office on Mar. 15, 2016 in corresponding Japanese Patent Application No. 2014-057579 and an English language translation (4 pages).

(Continued)

*Primary Examiner* — David Gray
*Assistant Examiner* — Kevin Butler
(74) *Attorney, Agent, or Firm* — Buchanan Ingersoll & Rooney PC

(57) ABSTRACT

A fixing device having: a heating unit; a first rotating member and rotating in a first rotational direction; a second rotating member contacting the first rotating member and thereby forming a nip through which a printing medium passes, wherein the second rotating member rotates in a second rotational direction opposite to the first rotational direction; a reflective member provided around the first rotating member and having a reflection surface provided so as to face the first rotating member; and an inhibitory member inhibiting air in a space between the reflective member and the first rotating member from flowing out through a first gap between a downstream end of the reflective member in the first rotational direction and a closest portion of the first rotating member to the downstream end of the reflective member, wherein the inhibitory member overlaps with a part of the first gap.

13 Claims, 4 Drawing Sheets

(56) References Cited

U.S. PATENT DOCUMENTS

| | | | | |
|---|---|---|---|---|
| 2007/0071515 | A1* | 3/2007 | Jang | G03G 15/2064 399/328 |
| 2007/0177895 | A1* | 8/2007 | Yano | G03G 21/20 399/122 |
| 2009/0110449 | A1 | 4/2009 | Saito et al. | |
| 2009/0245865 | A1* | 10/2009 | Shinshi | G03G 15/2064 399/122 |
| 2013/0302073 | A1 | 11/2013 | Takeuchi | |

FOREIGN PATENT DOCUMENTS

| | | | | |
|---|---|---|---|---|
| JP | 05-188805 | A | 7/1993 | |
| JP | 1993-188805 | * | 7/1993 | G03G 15/20 |
| JP | H08-254919 | A | 10/1996 | |
| JP | 2000-089596 | A | 3/2000 | |
| JP | 2003-215959 | * | 7/2003 | G03G 15/20 |
| JP | 2003-215959 | A | 7/2003 | |
| JP | 2004-109626 | A | 4/2004 | |
| JP | 2009-122632 | A | 6/2009 | |
| JP | 2012-008206 | A | 1/2012 | |
| JP | 2012-103612 | A | 5/2012 | |
| JP | 2013-235157 | A | 11/2013 | |

OTHER PUBLICATIONS

Office Action (Decision of Refusal) issued on Oct. 18, 2016, by the Japanese Patent Office in corresponding Japanese Patent Application No. 2014-057579, and English Translation of the Office Action. (4 pages).

* cited by examiner

FIXING DEVICE

This application is based on Japanese Patent Application No. 2014-057579 filed on Mar. 20, 2014, the content of which is incorporated herein by reference.

BACKGROUND OF THE INVENTION

1. Field of the Invention

The present invention relates to fixing devices, more particularly to a fixing device for use in an image forming apparatus.

2. Description of Related Art

As an invention relevant to a conventional fixing device, for example, a fixing device described in Japanese Patent Laid-Open Publication No. 5-188805 is known. This fixing device includes a thermal roller, a pressure roller, a heater, and a reflector. The thermal roller and the pressure roller are in contact with each other under pressure. The heater is provided in the thermal roller in order to heat the thermal roller. The reflector partially surrounds the thermal roller in order to reflect radiation heat of the thermal roller back toward the thermal roller. In this manner, by providing the reflector, heat loss in the fixing device is reduced.

Incidentally, in the fixing device described in Japanese Patent Laid-Open Publication No. 5-188805, heated air between the thermal roller and the reflector flows out of the space between the thermal roller and the reflector because of an air flow generated by the rotation of the thermal roller. Accordingly, the fixing device described in Japanese Patent Laid-Open Publication No. 5-188805 can reduce heat loss only to an insufficient degree.

SUMMARY OF THE INVENTION

A fixing device according to an embodiment of the present invention includes: a heating unit; a first rotating member being heated by the heating unit and rotating in a first rotational direction when viewed in a plan view in a predetermined direction; a second rotating member contacting the first rotating member and thereby forming a nip through which a printing medium passes, wherein the second rotating member rotates in a second rotational direction opposite to the first rotational direction when viewed in a plan view in the predetermined direction; a reflective member provided around the first rotating member when viewed in a plan view in the predetermined direction and having a reflection surface provided so as to face the first rotating member; and an inhibitory member inhibiting air in a space between the reflective member and the first rotating member from flowing out through a first gap between a downstream end of the reflective member in the first rotational direction and a closest portion of the first rotating member to the downstream end of the reflective member, wherein the inhibitory member overlaps with a part of the first gap when viewed in a plan view in a moving direction of the first rotating member at the closest portion of the first rotating member.

DETAILED DESCRIPTION OF THE PREFERRED EMBODIMENTS

Hereinafter, an image forming apparatus including a fixing device according to an embodiment of the present invention will be described with reference to the drawings.

Configuration of Image Forming Apparatus

Figure 1:
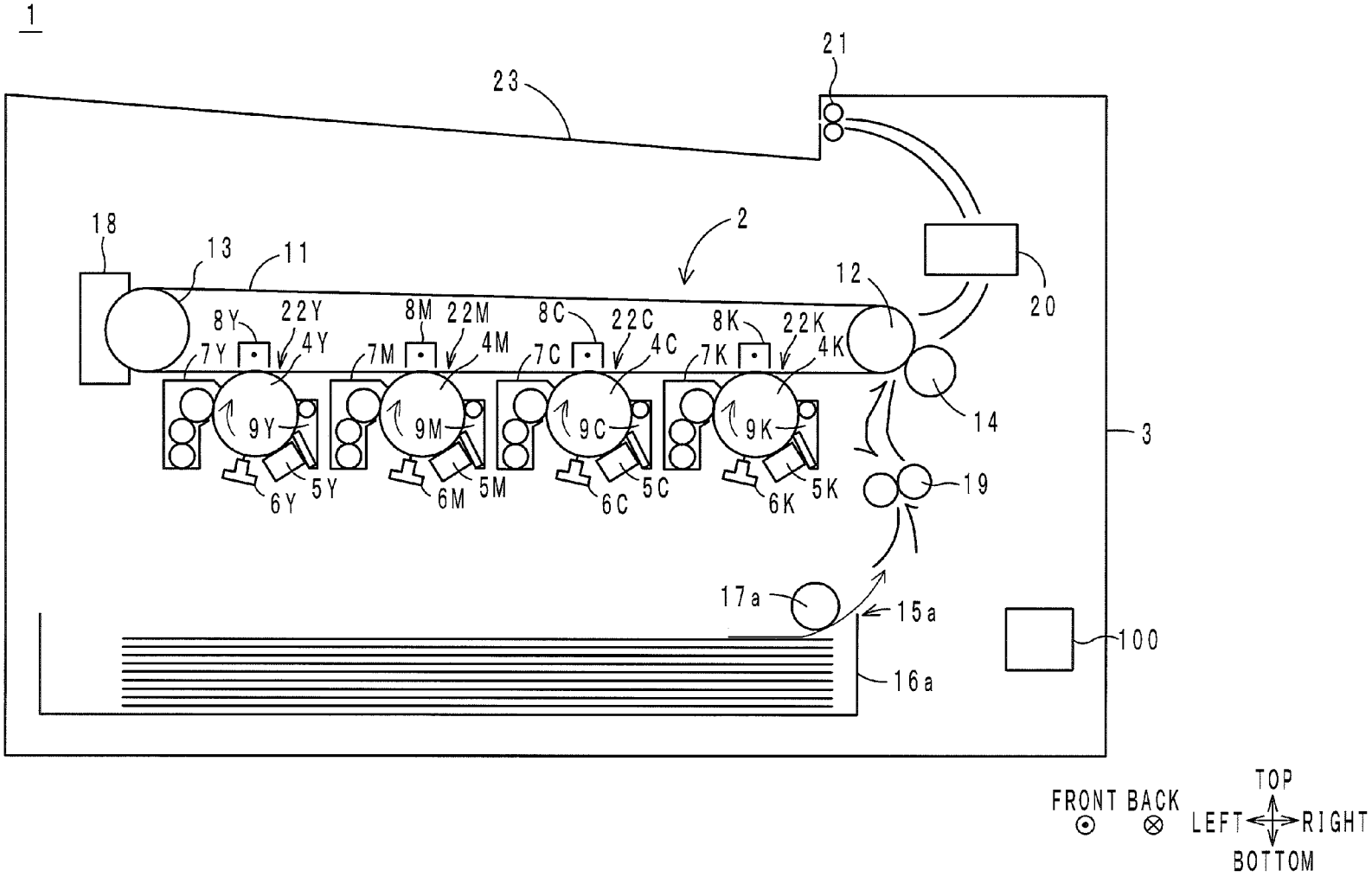
FIG. 1 is a diagram illustrating the overall configuration of an image forming apparatus 1.

The configuration of the image forming apparatus including the fixing device according to the embodiment of the present invention will be described below with reference to the drawings. FIG. 1 is a diagram illustrating the overall configuration of the image forming apparatus 1. The left-right direction of the sheet of FIG. 1 will be referred to simply as the left-right direction, the front-back direction of the sheet will be referred to simply as the front-back direction, and the top-bottom direction of the sheet will be referred to simply as the top-bottom direction.

The image forming apparatus 1 is an electrophotographic color printer of a so-called tandem type adapted to combine images in four colors (Y: yellow, M: magenta, C: cyan, and K: black). The image forming apparatus 1 has the function of forming an image on a sheet (printing medium) on the basis of image data obtained by a scanner, and includes a printing unit 2, a main body 3, a paper feed cassette 15*a*, a timing roller pair 19, the fixing device 20, an ejection roller pair 21, an output tray 23, and a control unit 100, as shown in FIG. 1.

The main body 3 is a housing for the image forming apparatus 1, and accommodates the printing unit 2, the paper feed cassette 15*a*, the timing roller pair 19, the fixing device 20, the ejection roller pair 21, and the control unit 100.

The paper feed cassette 15*a* plays the role of supplying sheets one by one, and generally includes a sheet tray 16*a* and a paper feed roller 17*a*. In the sheet tray 16*a*, a plurality of unprinted sheets are stacked and mounted. The paper feed roller 17*a* takes out the sheets mounted in the sheet tray 16*a* one by one.

The timing roller pair 19 forwards a sheet having been supplied by the paper feed cassette 15*a* while performing timing control such that the sheet is subjected to secondary transfer of toner images in the printing unit 2.

The printing unit 2 is adapted to form toner images on the sheet having been supplied by the paper feed cassette 15*a*, and includes imaging units 22Y, 22M, 22C, and 22K, optical scanning devices 6Y, 6M, 6C, and 6K, transfer units 8Y, 8M, 8C, and 8K, an intermediate transfer belt 11, a drive roller 12, a driven roller 13, a secondary transfer roller 14, and a cleaning device 18. Moreover, the imaging units 22Y, 22M, 22C, and 22K respectively include photoreceptor drums 4Y, 4M, 4C, and 4K, chargers 5Y, 5M, 5C, and 5K, developing devices 7Y, 7M, 7C, and 7K, and cleaners 9Y, 9M, 9C, and 9K.

The photoreceptor drums 4Y, 4M, 4C, and 4K are provided in the form of cylinders in the main body 3. The photoreceptor drums 4Y, 4M, 4C, and 4K are rotated clockwise in FIG. 1. The chargers 5Y, 5M, 5C, and 5K electrically charge the circumferential surfaces of the photoreceptor drums 4Y, 4M, 4C, and 4K. The optical scanning devices 6Y, 6M, 6C, and 6K under control of the control unit 100 scan beams BY, BM, BC, and BK (not shown) on the circumferential surfaces of the photoreceptor drums 4Y, 4M, 4C, and 4K. As a result, electrostatic latent images are formed on the circumferential surfaces of the photoreceptor drums 4Y, 4M, 4C, and 4K.

The developing devices 7Y, 7M, 7C, and 7K are provided in the main body 3 in order to apply toner to the photoreceptor drums 4Y, 4M, 4C, and 4K and thereby develop toner images based on the electrostatic latent images.

The intermediate transfer belt 11 is stretched between the drive roller 12 and the driven roller 13. The intermediate transfer belt 11 is subjected to primary transfer of the toner images developed on the photoreceptor drums 4Y, 4M, 4C, and 4K. The transfer units 8Y, 8M, 8C, and 8K are disposed so as to face the inner circumferential surface of the intermediate transfer belt 11, and play the role of subjecting the intermediate transfer belt 11 to primary transfer of toner images formed on the photoreceptor drums 4Y, 4M, 4C, and 4K. The cleaners 9Y, 9M, 9C, and 9K collect toner remaining on the circumferential surfaces of the photoreceptor drums 4Y, 4M, 4C, and 4K after primary transfer. The drive roller 12 is caused to rotate by an intermediate transfer belt drive unit (not shown in FIG. 1), thereby driving the intermediate transfer belt 11 counterclockwise. As a result, the intermediate transfer belt 11 carries the toner images to the secondary transfer roller 14.

The secondary transfer roller 14 is in the form of a drum facing the intermediate transfer belt 11. Upon application of a voltage for transfer, the secondary transfer roller 14 subjects a sheet passing between the intermediate transfer belt 11 and the secondary transfer roller 14 to secondary transfer of the toner images carried on the intermediate transfer belt 11. After the secondary transfer of the toner images onto the sheet, the cleaning device 18 removes toner remaining on the intermediate transfer belt 11.

The sheet subjected to the secondary transfer of the toner images is transported to the fixing device 20. The fixing device 20 heats and presses the sheet, thereby fixing the toner images on the sheet.

The ejection roller pair 21 ejects the sheet transported through the fixing device 20 onto the output tray 23. In this manner, printed sheets are deposited on the output tray 23.

The control unit 100 is, for example, a CPU, and is adapted to control the operation of the image forming apparatus 1.

Configuration of Fixing Device

Figure 2:
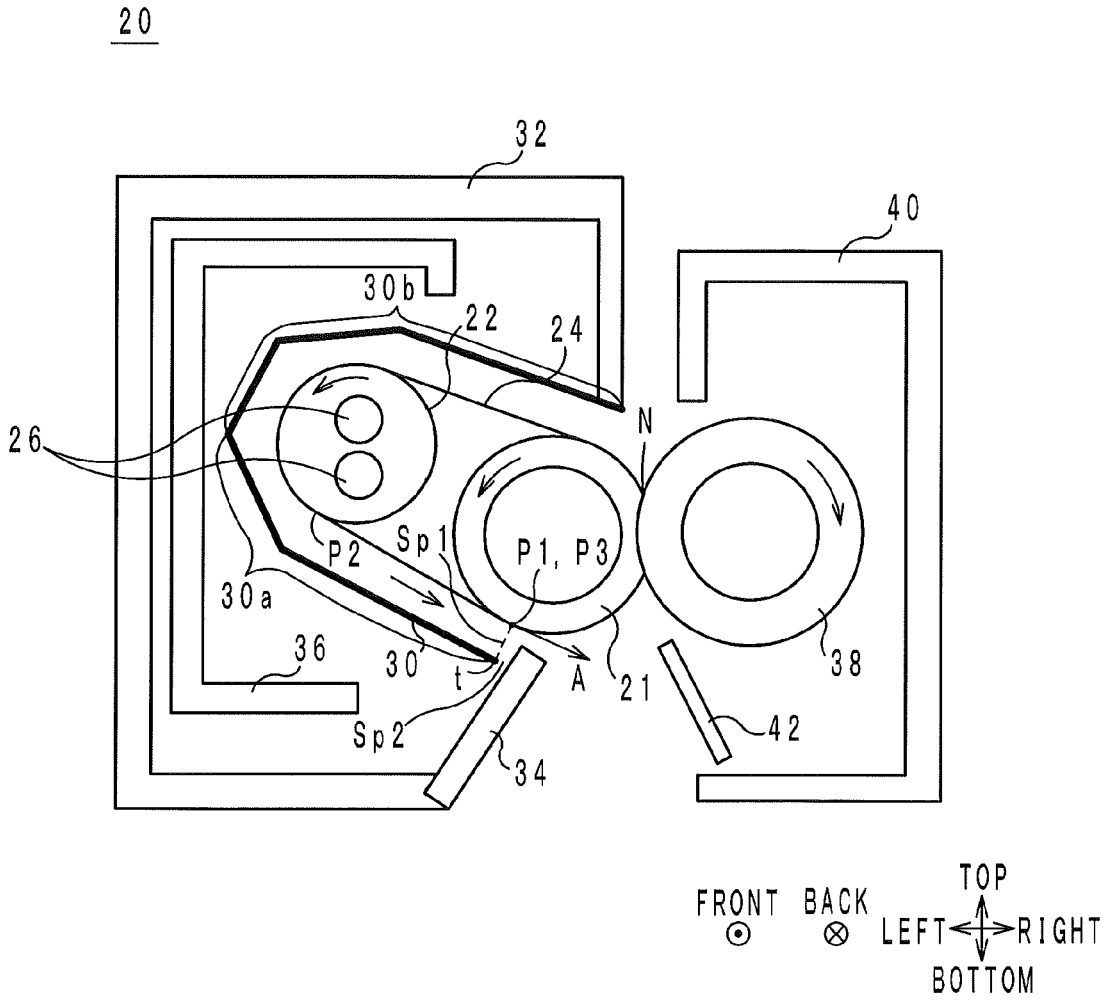
FIG. 2 is a configuration diagram of a fixing device 20.

The configuration of the fixing device 20 will be described below with reference to the drawings. FIG. 2 is a configuration diagram of the fixing device 20.

The fixing device 20 includes a fixing roller 21, a heating roller 22, a fixing belt 24, a halogen heater 26, a reflector 30, an external cover 32, a rib 34, an internal cover 36, a pressure roller 38, a cover 40, and a guide 42, as shown in FIG. 2.

The fixing roller 21 is a columnar member extending in the front-back direction, and is supported by bearings near the opposite ends in the front-back direction so as to be rotatable about an axis extending in the front-back direction. However, the fixing roller 21 is not a drive roller to be rotated by a drive source such as a motor, but a driven roller to be rotated by receiving an external force. The fixing roller 21 is formed, for example, by stacking a silicone rubber layer and a silicone sponge in this order, from bottom to top, around a core, which is a metallic rod. The fixing roller 21 has an outer diameter of 25 mm. The core is, for example, a solid metallic rod made with sulfur and sulfur free-machining steel (SUM24). Moreover, the silicone rubber layer and the silicone sponge are 2-mm thick. Providing the silicone rubber layer and the silicone sponge imparts elasticity to the surface of the fixing roller 21.

The heating roller 22 is a cylindrical member extending in the front-back direction, and is supported by bearings near the opposite ends in the front-back direction so as to be rotatable about an axis extending in the front-back direction. However, the heating roller 22 is not a drive roller to be rotated by a drive source such as a motor, but a driven roller to be rotated by receiving an external force. The heating roller 22 is disposed diagonally above and to the left of the fixing roller 21. The heating roller 22 has an outer diameter of mm and a thickness of 0.3 mm. Moreover, the inner circumferential surface of the heating roller 22 is painted in black. The heating roller 22 is a cylindrical metallic tube, e.g., a carbon steel tube for machine structural purposes (STKM).

The fixing belt 24 is stretched between the fixing roller 21 and the heating roller 22, and is caused to rotate, when viewed in a front view, by the rotation of the fixing roller 21 and the heating roller 22. The fixing belt 24 extends diagonally upwards to the left between the fixing roller 21 and the heating roller 22. The fixing belt 24 is formed, for example, by stacking a silicone rubber layer and a perfluoroalkoxy (PFA) resin layer in this order, from bottom to top, on a base material. The fixing belt 24 has an inner diameter of 40 mm. The base material has a thickness of 60 μm, the silicone rubber layer has a thickness of 100 μm, and the PFA resin layer has a thickness of 12 μM. Moreover, the tension in the fixing belt 24 is 50 N. The tension in the fixing belt 24 is appropriately achieved, for example, by pulling the heating roller 22 in a direction away from the fixing roller 21. The fixing belt 24 is extremely thin, as described above, and therefore, can be heated to such a temperature that image fixing can be performed, in a short period of time of about 20 seconds.

The fixing belt 24 has a portion in contact with the heating roller 22, and the downstream end of the portion in the counterclockwise direction will be referred to below as "portion P2". The fixing belt 24 has another portion in contact with the fixing roller 21, and the upstream end of the portion in the counterclockwise direction will be referred to below as "portion P3". The heating roller 22 is disposed diagonally above and to the left of the fixing roller 21. Accordingly, portion P2 is located at a higher position than portion P3.

The halogen heater 26 is a heat generator provided in the heating roller 22 and extending in the front-back direction. The halogen heater 26 heats the heating roller 22. As a result, the fixing belt 24 is heated by the heating roller 22 at the portion that is in contact with the heating roller 22. That is, the halogen heater 26 heats the fixing belt 24. The halogen heater 26 consumes 1200 W of power, and heats an area measuring at least 300 mm in the front-back direction.

The pressure roller 38 is a columnar member extending in the front-back direction, and is supported near the opposite ends in the front-back direction so as to be rotatable about an axis extending in the front-back direction. The pressure roller 38 is provided to the right of the fixing roller 21 so as to exert pressure upon the fixing roller 21 through the fixing belt 24. That is, the pressure roller 38 contacts the fixing belt 24 on the fixing roller 21. Accordingly, there is a nip N formed between the fixing belt 24 and the pressure roller 38. The nip N is an area through which a printing medium with toner images formed thereon passes. When passing through the nip N, the toner images are situated on the (left) side of the printing medium that faces toward the fixing roller 21.

The dimension of the nip N in the top-bottom direction is 8 mm. Moreover, the pressure roller 38 presses on the fixing roller 21 at the nip N with a force of 400 N.

Further, the pressure roller 38 is a drive roller to be rotated clockwise, when viewed in a front view, by a drive source such as a motor. The pressure roller 38 presses on the fixing roller 21, as described earlier. Accordingly, in the case where the pressure roller 38 is rotated clockwise when viewed in a front view, the fixing belt 24, the fixing roller 21, and the heating roller 22 are rotated counterclockwise. Note that the pressure roller 38 is rotated such that the transportation speed of the printing medium passing through the nip N is 210 mm/s.

Still further, the pressure roller 38 is formed, for example, by stacking a silicone rubber layer and a PFA resin layer in this order, from bottom to top, around a core, which is a metallic rod. The pressure roller 38 has an outer diameter of 27 mm. The core is, for example, a solid metallic rod or a carbon steel tube for machine structural purposes (STKM). Moreover, the silicone rubber layer has a thickness of 4 mm, and the PFA resin layer has a thickness of 30 μm. Providing the silicone rubber layer imparts elasticity to the surface of the pressure roller 38.

The reflector 30, when viewed in a front view, is provided around the fixing belt 24 and has a reflective surface facing the fixing belt 24. The reflector 30 reflects radiation heat of the fixing belt 24 back toward the fixing belt 24. The reflector 30, when viewed in a front view, extends at least along the portion of the fixing belt 24 that is in contact with the heating roller 22. That is, the reflector 30 extends at least along the portion of the fixing belt 24 that is to be heated. In the present embodiment, the reflector 30 faces a large part of the fixing belt 24. The upstream end of the reflector 30 in the counterclockwise direction is situated almost directly above the center of the fixing roller 21, and the downstream end of the reflector 30 in the counterclockwise direction is situated almost directly below the center of the fixing roller 21.

Furthermore, the reflector 30, when viewed in a front view, is not curved along the fixing belt 24 but has a shape made up of straight lines bent at multiple points. Accordingly, the distance between the reflector 30 and the fixing belt 24 is not uniform. However, the reflector 30 should be neither too close to nor too far away from the fixing belt 24. If the reflector 30 is too close to the fixing belt 24, excessive heat from the fixing belt 24 is transmitted to the reflector 30, and if the reflector 30 is too far away from the fixing belt 24, heat is reflected insufficiently toward the fixing belt 24. When the temperature of the fixing belt 24 is within the range from 130° C. to 190° C., the distance between the reflector 30 and the fixing belt 24 is preferably 7 mm.

However, the fixing belt 24 is heated by the halogen heater 26 immediately before the fixing belt 24 passes through a first section, which is located on the upstream side in the counterclockwise direction relative to the nip N and extends from the heating roller 22 to the nip N. Accordingly, the temperature of the reflector 30 tends to be relatively high in the first section. On the other hand, the fixing belt 24 becomes cool at the nip N immediately before the fixing belt 24 passes through a second section, which is located on the downstream side in the counterclockwise direction relative to the nip N and extends from the nip N to the heating roller 22. Accordingly, the temperature of the reflector 30 tends not to be relatively high in the second section. Therefore, the distance between the reflector 30 and the fixing belt 24 is set to be shorter in the second section than in the first section. For example, the distance between the reflector 30 and the fixing belt 24 in the first section is preferably 7 mm. On the other hand, the distance between the reflector 30 and the fixing belt 24 in the second section is preferably 6 mm.

The reflector 30 as above consists of a bottom part 30*a* and a top part 30*b*. The top part 30*b* constitutes an upper portion of the reflector 30. The bottom part 30*a* constitutes a lower portion of the reflector 30. The bottom part 30*a* and the top part 30*b* are made as individual members for the purpose of easy assembly.

The material of the reflector 30 preferably has low emissivity, low thermal conductivity, and low thermal capacity. However, the emissivity has higher importance than the thermal conductivity and the thermal capacity, and therefore, is prioritized for material selection. The reflector 30 may be made, for example, by subjecting a metallic material, such as aluminum, steel, or stainless steel, or a resin material, to surface treatment such as polishing or vapor deposition, or by plating such a metallic material or a resin material with aluminum. Moreover, the thickness of the reflector 30 is determined while balancing the strength of the reflector 30 and the degree of the thermal capacity to be reduced. In the case where the reflector 30 is made with a metallic material, the reflector 30 has a thickness of from 0.5 mm to 1.5 mm. In the case where the reflector 30 is made with a resin material, the reflector 30 has a thickness of from 1.5 mm to 2.5 mm.

The rib 34 is a plate-like member provided near the downstream end t of the reflector 30 in the counterclockwise direction so as to overlap with a part of gap Sp1 between the fixing belt 24 and the reflector 30. More details will be described below.

First, the closest portion of the fixing belt 24 to the end t is defined as closest portion P1. In the present embodiment, closest portion P1 coincides with portion P3. However, closest portion P1 does not have to coincide with portion P3. Moreover, the moving direction of the fixing belt 24 at closest portion P1 is defined as moving direction A. In this case, gap Sp1 lies between the end t and closest portion P1, as shown in FIG. 2. Moreover, when viewed in a plan view in moving direction A, the rib 34 overlaps with a part of gap Sp1. The part of gap Sp1 is a predetermined area from the bottom of gap Sp1 (i.e., from the end t). The top edge of the rib 34 is not in contact with the fixing belt 24, so that there is some gap therebetween. The top edge of the rib 34 is located closer than the end t of the reflector 30 to the fixing belt 24. However, if the top edge of the rib 34 is located too close to the fixing belt 24, radiation heat of the fixing belt 24 is transmitted to the rib 34. Accordingly, the clearance between the rib 34 and the fixing belt 24 is preferably, for example, from 1 mm to 5 mm. This allows the rib 34 to function as an inhibitory member for preventing air in the space between the reflector 30 and the fixing belt 24 from flowing out through gap Sp1.

Furthermore, there is gap Sp2 between the rib 34 and the end t of the reflector 30. Accordingly, a slight amount of air escapes from the space between the reflector 30 and the fixing belt 24 through gap Sp2. Here, the rib 34 is required to be close to gap Sp1 to such an extent that air in the space between the reflector 30 and the fixing belt 24 is prevented from flowing out through gap Sp1. Therefore, gap Sp2 is preferably from about 1 mm to about 3 mm.

The rib 34 extends below the fixing roller 21 diagonally upwards from left to right. Accordingly, the rib 34 functions as a guide for directing a printing medium transported from therebelow toward the nip N.

The rib 34 thus configured preferably does not transmit radiation heat of the fixing belt 24 to surrounding members.

Accordingly, the rib 34 is made with a material having low thermal conductivity, e.g., resin.

The external cover 32 is located outside the reflector 30 relative to the fixing belt 24 so as to partially surround the reflector 30 and the fixing belt 24. More specifically, the external cover 32 is a box-like member having a rectangular shape in a cross-section perpendicular to the front-back direction. Moreover, the external cover 32 accommodates the fixing roller 21, the heating roller 22, the fixing belt 24, the reflector 30, and the internal cover 36 (to be described in detail later). However, the external cover 32 is cut out both at a lower portion of the right-side surface and at a right-end portion of the bottom surface, so that the external cover 32 is open at the lower right corner. As a result, the fixing roller 21 and the portion of the fixing belt 24 that is in contact with the fixing roller 21 are exposed to the outside from the external cover 32.

Furthermore, the upstream end of the reflector 30 in the counterclockwise direction is connected to the bottom edge of the right-side surface of the external cover 32. Accordingly, the space above the reflector 30 is closed. Moreover, the bottom edge of the rib 34 is connected to the right end of the bottom surface of the external cover 32. That is, the rib 34 is fixed to the external cover 32. Therefore, the space within the external cover 32 is not in communication with the outside of the external cover 32, except at gaps Sp1 and Sp2.

The internal cover 36, when viewed in a front view, is provided between the reflector 30 and the external cover 32. More specifically, the internal cover 36, when viewed in a front view, is located outside the reflector 30 relative to the fixing belt 24 so as to extend around the top, left, and bottom of the heating roller 22. Moreover, the top surface of the internal cover 36 is slightly bent downward at the right edge.

The cover 40 partially surrounds the pressure roller 38. More specifically, the cover 40 is a box-like member having a rectangular shape in a cross-section perpendicular to the front-back direction. Moreover, the cover 40 accommodates the pressure roller 38. However, the cover 40 is cut out at a portion of the left-side surface, so that the cover 40 is open at the left side. As a result, the pressure roller 38 is exposed to the outside from the cover 40.

The guide 42 extends below the pressure roller 38 diagonally upwards from right to left. Accordingly, the guide 42 directs a printing medium transported from therebelow toward the nip N.

Effects

The fixing device 20 according to the present embodiment makes it possible to further reduce heat loss. More specifically, in the fixing device 20, when the fixing belt 24 rotates counterclockwise, a counterclockwise air flow occurs in the space between the fixing belt 24 and the reflector 30. The air between the fixing belt 24 and the reflector 30 is warmed by radiation heat of the fixing belt 24. Accordingly, when such an air flow occurs, warmed air might escape from the space between the fixing belt 24 and the reflector 30 through gap Sp1.

Therefore, in the fixing device 20, the rib 34, when viewed in moving direction A, overlaps with a portion of gap Sp1. The rib 34 prevents warmed air from flowing out of the space between the fixing belt 24 and the reflector 30 through gap Sp1. As a result, the temperature in the space between the fixing belt 24 and the reflector 30 is inhibited from decreasing. Thus, heat loss in the fixing device 20 is reduced.

Furthermore, the fixing device 20 renders it possible to additionally reduce heat loss also for the following reasons. Specifically, the external cover 32 partially surrounds the reflector 30 and the fixing belt 24. In addition, there is gap Sp2 between the rib 34 and the end t of the reflector 30. Accordingly, once the fixing belt 24 starts rotating counterclockwise, some warm air in the space between the fixing belt 24 and the reflector 30 flows into the external cover 32 through gap Sp2, and remains in the external cover 32. The warm air having flowed into the external cover 32 plays the role of keeping the temperature in the external cover 32 high when the fixing belt 24 is not rotating. Thus, heat loss in the fixing device 20 is reduced.

The warm air having flowed into the external cover 32 is retained in the space bounded by the internal cover 36. The internal cover 36 extends along a part of the reflector 30. Accordingly, the air in the internal cover 36 plays the role of keeping the temperature in the fixing device 20 high when the fixing belt 24 is not rotating. Thus, heat loss in the fixing device 20 is reduced.

Furthermore, since the internal cover 36 is shaped such that the top surface is bent downward at the right edge, warmed air tends to accumulate near the top surface of the internal cover 36. Thus, the temperature in the fixing device 20 is more effectively kept high, so that heat loss in the fixing device 20 is further reduced.

In the fixing device 20, the fixing belt 24 extends between the fixing roller 21 and the heating roller 22 diagonally upwards to the left. Accordingly, warmed air is guided diagonally upwards along the fixing belt 24. As a result, the warmed air is inhibited from flowing out of the space between the fixing belt 24 and the reflector 30 through gap Sp1. Thus, heat loss in the fixing device 20 is further reduced.

Furthermore, the fixing device 20 renders it possible to additionally reduce heat loss also for the following reasons. The fixing belt 24 has a portion in contact with the heating roller 22, and portion P2 is located at the downstream end of the portion in the counterclockwise direction. The fixing belt 24 has another portion in contact with the fixing roller 21, and portion P3 is located at the upstream end of the portion in the counterclockwise direction. In the fixing device 20, the temperature is higher in portion P2 than in portion P3. Portion P2 is located at a higher position than portion P3. Accordingly, in the state where the fixing belt 24 is not rotating, warm air around portion P2 stays in a high position within the space between the fixing belt 24 and the reflector 30, and therefore, is prevented from flowing out of the space between the fixing belt 24 and the reflector 30 through gap Sp1. Thus, heat loss in the fixing device 20 is further reduced.

Still further, the fixing device 20 renders it possible to reduce heat loss also for the following reasons. Specifically, the reflector 30, when viewed in a front view, is not curved along the fixing belt 24 but has a shape made up of straight lines bent at multiple points. From the viewpoint of keeping the distance between the fixing belt 24 and the reflector 30 uniform, it is preferable that the reflector 30 has a curved shape. However, by providing the reflector 30 in a shape made up of straight lines bent at multiple points, the flow of air is hindered at the bent portions when the fixing belt 24 is rotating. Accordingly, warm air tends to stay within the space between the fixing belt 24 and the reflector 30. Thus, heat loss in the fixing device 20 is reduced.

In the fixing device 20, the reflector 30 has a shape made up of straight lines bent at multiple points. Making the reflector 30 thus shaped by bending a metallic plate can be done more readily than making curved reflective members. Accordingly, the fixing device 20 can be produced readily. However, this does not prohibit the reflector 30 from being curved.

Furthermore, the fixing device 20 renders it possible to reduce heat loss also for the following reasons. Specifically, the fixing belt 24 is heated by the halogen heater 26 immediately before the fixing belt 24 passes through the first section, which is located on the upstream side relative to the nip N in the counterclockwise direction and extends from the heating roller 22 to the nip N. Accordingly, the temperature of the reflector 30 tends to be relatively high in the first section. On the other hand, the fixing belt 24 becomes cool at the nip N immediately before the fixing belt 24 passes through the second section, which is located on the downstream side relative to the nip N in the counterclockwise direction and extends from the nip N to the heating roller 22. Accordingly, the temperature of the reflector 30 tends not to be relatively high in the second section. Therefore, the distance between the reflector 30 and the fixing belt 24 is set to be shorter in the second section than in the first section. As a result, the reflector 30 can efficiently reflect radiation heat of the fixing belt 24 in the second section, and also, the reflector 30 is inhibited from diffusing heat widely in the first section. Thus, heat loss in the fixing device 20 can be reduced.

The reflector 30 is made with a metallic material, so that the reflector 30 can have low emissivity and high reflectivity. Thus, heat loss in the fixing device 20 can be reduced.

First Modification

Figure 3:
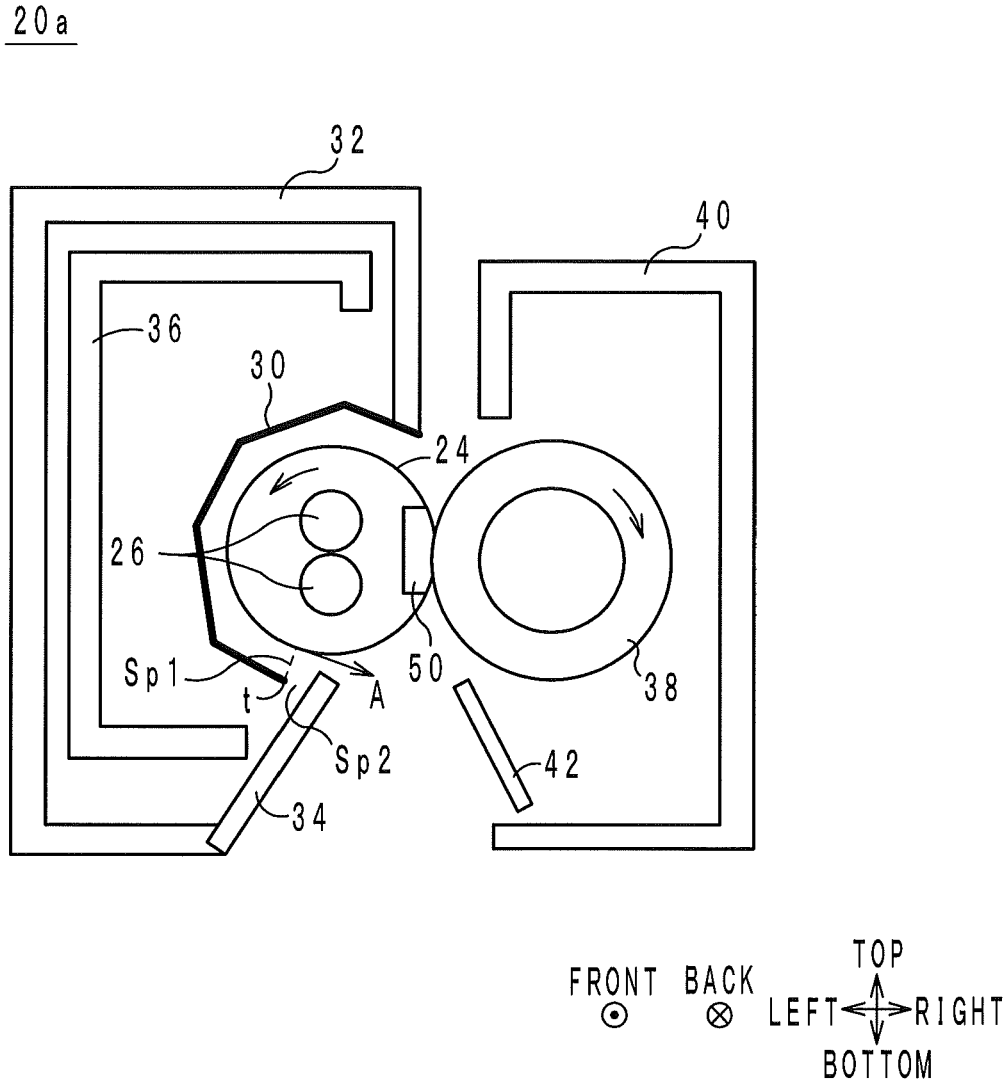
FIG. 3 is a configuration diagram of a fixing device 20*a* according to a first modification.

Hereinafter, a fixing device according to a first modification will be described with reference to the drawings. FIG. 3 is a configuration diagram of the fixing device 20*a* according to the first modification.

The fixing device 20*a* differs from the fixing device 20 in that neither the fixing roller 21 nor the heating roller 22 is provided, and a pressure pad 50 is provided. The fixing device 20*a* will be described below mainly with regard to the differences.

In the fixing device 20*a*, the fixing belt 24 is in the form of a cylinder extending in the front-back direction. Moreover, the halogen heater 26 is provided inside the fixing belt 24 in order to heat the fixing belt 24 directly.

Furthermore, the pressure pad 50 is located inside the fixing belt 24 so as to be in contact with the right side of the inner circumferential surface of the fixing belt 24 under pressure. The fixing belt 24 is also in contact with the pressure roller 38 under pressure.

Still further, the reflector 30, when viewed in a front view, extends along the fixing belt 24. More specifically, the reflector 30, when viewed in a front view, extends along approximately half of the fixing belt 24 from near the top to near the bottom. However, the reflector 30 is simply required to extend from above to below the level of the center of the fixing belt 24 when viewed in a front view. That is, it is simply required that the upstream end of the reflector 30 in the counterclockwise direction is located at least at a higher level than the center of the fixing belt 24 when viewed in a front view. Likewise, it is simply required that the downstream end of the reflector 30 in the counterclockwise direction is located at least at a lower level than the center of the fixing belt 24 when viewed in a front view.

The fixing device 20*a* thus configured can achieve the same effects as those achieved by the fixing device 20.

Second Modification

Figure 4:
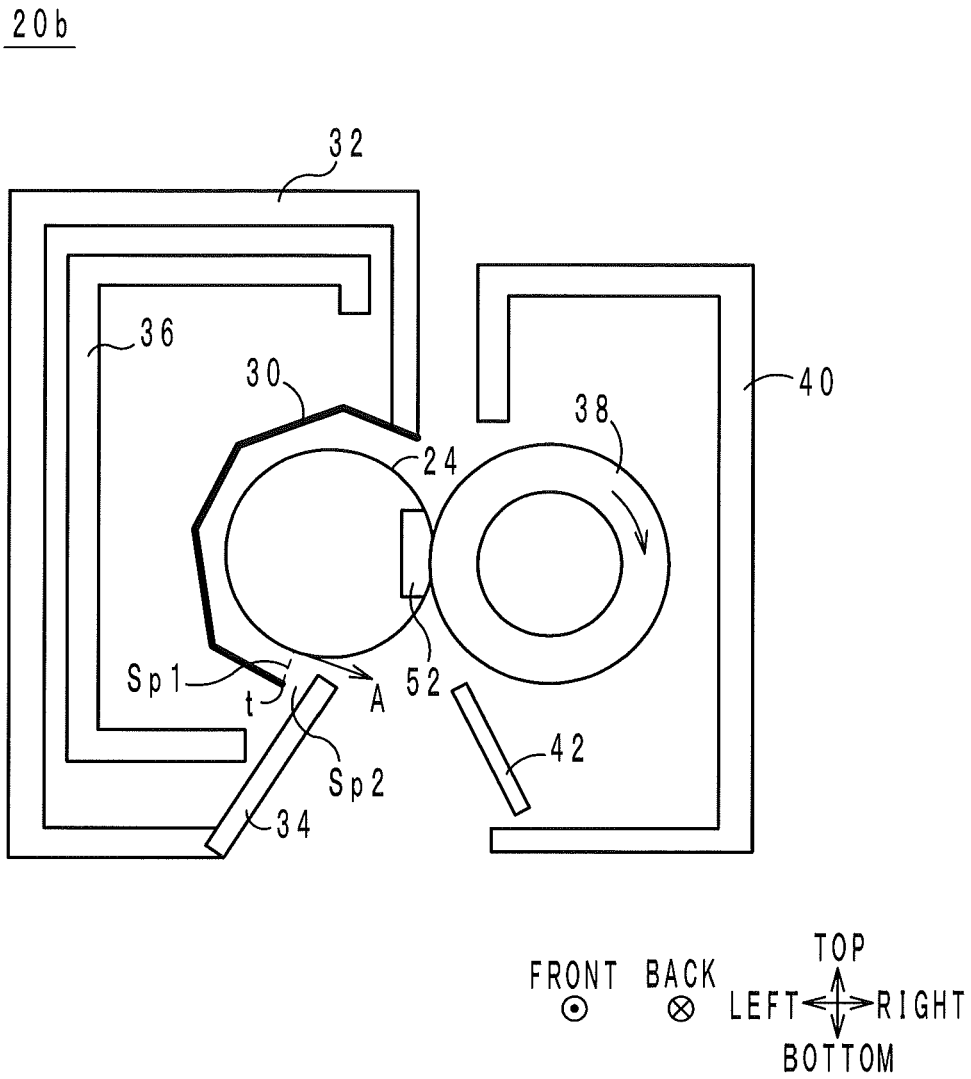
FIG. 4 is a configuration diagram of a fixing device 20*b* according to a second modification.

Hereinafter, a fixing device according to a second modification will be described with reference to the drawings. FIG. 4 is a configuration diagram of the fixing device 20*b* according to the second modification.

The fixing device 20*b* differs from the fixing device 20*a* in that a ceramic heater 52 is provided in place of the halogen heater 26 and the pressure pad 50. The ceramic heater 52 is located inside the fixing belt 24 so as to be in contact with the right side of the inner circumferential surface of the fixing belt 24 under pressure. The fixing belt 24 is also in contact with the pressure roller 38. Moreover, the ceramic heater 52 heats the fixing belt 24.

The fixing device 20*b* thus configured can achieve the same effects as those achieved by the fixing device 20*a*.

Other Embodiments

The present invention is not limited to the fixing devices 20, 20*a*, and 20*b*, and changes can be made within the spirit and scope of the invention.

The reflector 30 and the rib 34 may be in contact with each other, but their contact area is preferably kept as small as possible. As a result, thermal conduction between the reflector 30 and the rib 34 is inhibited from occurring.

The rib 34 may be integrated with the external cover 32. This reduces the number of parts.

The fixing roller 21 may be located diagonally above the heating roller 22.

Although the present invention has been described in connection with the preferred embodiment above, it is to be noted that various changes and modifications are possible to those who are skilled in the art. Such changes and modifications are to be understood as being within the scope of the invention.

What is claimed is:

1. A fixing device, comprising: a heating unit; a first rotating member being heated by the heating unit and rotating in a first rotational direction when viewed in a plan view in a predetermined direction; a second rotating member contacting the first rotating member and thereby forming a nip through which a printing medium passes, wherein the second rotating member rotates in a second rotational direction opposite to the first rotational direction when viewed in a plan view in the predetermined direction; a reflective member provided around the first rotating member when viewed in a plan view in the predetermined direction and having a reflection surface provided so as to face the first rotating member; and an inhibitory member inhibiting air in a space between the reflective member and the first rotating member from flowing out through a first gap between a downstream end of the reflective member in the first rotational direction and a closest portion of the first rotating member to the downstream end of the reflective member, wherein the inhibitory member overlaps with a part of the first gap when viewed in a plan view in a moving direction of the first rotating member at the closest portion of the first rotating member.

2. The fixing device according to claim 1, wherein the inhibitory member functions as a guide for directing a printing medium to the nip.

3. The fixing device according to claim 1, further comprising: a first roller; and a second roller, wherein, the first rotating member is a belt stretched between the first roller and the second roller, the second rotating member contacts the first rotating member on the first roller, and the heating unit is provided in the second roller.

4. The fixing device according to claim 3, wherein the reflective member is provided along a portion of the first rotating member that is in contact with the second roller when viewed in a plan view in the predetermined direction.

5. The fixing device according to claim 3, wherein the first rotating member extends diagonally upwards between the first roller and the second roller.

6. The fixing device according to claim 3, wherein the first rotating member is in contact with the second roller such that a downstream end of the contact portion in the first rotational direction is located at a higher position than an end of a contact portion of the first rotating member with the second roller, the end being an upstream end in the first rotational direction.

7. The fixing device according to claim 1, wherein the first rotating member has a cylindrical shape extending in the predetermined direction, and the reflective member extends from above to below the level of the center of the first rotating member when viewed in a plan view in the predetermined direction.

8. The fixing device according to claim 1, wherein a second gap is provided between the downstream end of the reflective member in the first rotational direction and the inhibitory member.

9. The fixing device according to claim 8, further comprising a cover located outside the reflective member relative to the first rotating member and partially surrounding the reflective member and the first rotating member, wherein, the inhibitory member is fixed to the cover.

10. The fixing device according to claim 1, further comprising an external cover attached to a bottom edge of the inhibitory member and attached to an upstream end of the reflective member, such that a space above the reflective member is closed.

11. The fixing device according to claim 1, wherein the inhibitory member extends in a direction that is substantially perpendicular to the downstream end of the reflective member.

12. A fixing device comprising:

a heating unit;

a first rotating member that is heated by the heating unit, the first rotating member configured to rotate in a first rotational direction when viewed in a plan view in a predetermined direction;

a second rotating member in contact with the first rotating member, the second rotating member configured to rotate in a second rotational direction opposite to the first rotational direction when viewed in a plan view in the predetermined direction;

a nip through which a printing medium passes formed by the contact between the first and second rotating members;

a reflective member comprising a plurality of straight line segments arranged around the first rotating member when viewed in a plan view in the predetermined direction and a reflection surface facing the first rotating member; and an inhibitory member arranged to inhibit heated air from flowing out of a gap between a downstream end of the reflective member in the first rotational direction and a portion of the first rotational member closest to the downstream end of the reflective member.

13. The fixing device according to claim 12, wherein the plurality of straight line segments are arranged at varying distances from the first rotating member such that a distance between the reflective member and the first rotating member is not uniform.

* * * * *